US010267244B2

(12) United States Patent
Doyama et al.

(10) Patent No.: US 10,267,244 B2
(45) Date of Patent: Apr. 23, 2019

(54) CONTROL APPARATUS FOR INTERNAL COMBUSTION ENGINE

(71) Applicant: HONDA MOTOR CO., LTD., Tokyo (JP)

(72) Inventors: Daisuke Doyama, Wako (JP); Shogo Kanaumi, Wako (JP); Satoru Okoshi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 15/850,748

(22) Filed: Dec. 21, 2017

(65) Prior Publication Data

US 2018/0202372 A1 Jul. 19, 2018

(30) Foreign Application Priority Data

Jan. 13, 2017 (JP) ..... 2017-004516

(51) Int. Cl.
*F02D 9/00* (2006.01)
*F02D 9/08* (2006.01)
(Continued)

(52) U.S. Cl.
CPC ..... *F02D 41/0002* (2013.01); *F02D 9/08* (2013.01); *F02D 11/105* (2013.01); *F02D 41/045* (2013.01); *F02D 2200/0404* (2013.01)

(58) Field of Classification Search
CPC ..... F02D 9/00; F02D 9/02; F02D 41/0002; F02D 9/105; F02D 2011/101
(Continued)

(56) References Cited

U.S. PATENT DOCUMENTS 4,790,286 A * 12/1988 Nishida ..... F02D 41/0052 123/568.27
4,951,634 A * 8/1990 Nishizawa ..... F02D 41/10 123/492
(Continued)

FOREIGN PATENT DOCUMENTS

EP 2415994 A1 2/2012
JP 10-159627 A 6/1998

OTHER PUBLICATIONS

Extended European Search Report, dated May 25, 2018, for European Application No. 18151207.0.

*Primary Examiner* — John Kwon
(74) *Attorney, Agent, or Firm* — Birch, Stewart, Kolasch & Birch, LLP

(57) ABSTRACT

A control apparatus for an internal combustion engine, includes: a throttle operator; an opening degree detector that detects an operation opening degree of the throttle operator; and an electronic control throttle device that opens and closes a throttle valve disposed in an intake passage of the engine, depending on the operation opening degree detected by the opening degree detector. A throttle valve opening degree of the throttle valve is set to include a zero output throttle opening degree angle at which an output of the engine becomes zero between a low rotational speed region and a high rotational speed region of the engine. The operation opening degree of the throttle operator corresponding to the zero output throttle opening degree angle is set to an opening-side angle ratio that falls within a range between 8% and 12%, both inclusive, with respect to a fully-open opening degree of the throttle operator.

6 Claims, 6 Drawing Sheets

(51) Int. Cl.
*F02D 41/00* (2006.01)
*F02D 11/10* (2006.01)
*F02D 41/04* (2006.01)

(58) Field of Classification Search
USPC ..... 123/319, 337, 376, 402, 403
See application file for complete search history.

(56) References Cited

U.S. PATENT DOCUMENTS

| | | | | |
|---|---|---|---|---|
| 4,984,552 | A * | 1/1991 | Nishizawa | F02D 41/045 123/492 |
| 6,076,502 | A * | 6/2000 | Katashiba | F02D 21/08 123/435 |
| 2002/0120385 | A1 | 8/2002 | Mehta et al. | |
| 2006/0229158 | A1 | 10/2006 | Ichihara | |
| 2009/0055060 | A1 | 2/2009 | Minami | |
| 2015/0232098 | A1 | 8/2015 | Crombez et al. | |

* cited by examiner

CONTROL APPARATUS FOR INTERNAL COMBUSTION ENGINE

BACKGROUND OF THE INVENTION

Field of the Invention

The present invention relates to a control apparatus for an internal combustion engine, including a throttle valve disposed in an intake passage of the internal combustion engine, a throttle operator, an operation amount detector that detects an operation amount of the throttle operator, and an electronic control throttle device that opens and closes the throttle valve in the intake passage in accordance with a degree detected by the operation amount detector.

Description of the Related Art

In controlling an internal combustion engine using an electronic control throttle device as in a conventional four-wheel vehicle, a known approach is to, as disclosed in, for example, Japanese Patent Application Laid-open No. 10-159627, reduce deceleration shock by changing a target throttle opening degree from a basic throttle opening degree to a zero output throttle opening degree that zeroes an output of the internal combustion engine when the throttle opening degree is smaller than a predetermined opening degree during deceleration.

A vehicle, such as a two-wheeled motor vehicle in which quick throttle operation is performed manually, requires that open/close operation on the throttle valve side be performed frequently and more accurately. In such a vehicle, or particularly in a vehicle in which an internal combustion engine with a high output is mounted, the rider is required to have skilled ability before he or she can use the conventional manual throttle device to perform a throttle operation that makes the output of the engine compatible with drivability through the setting of the throttle valve opening degree in a low throttle opening degree region.

SUMMARY OF THE INVENTION

The present invention has been made in view of the foregoing situation and it is an object of the present invention to provide a control apparatus for an internal combustion engine, enabling a rider, even without skilled ability, to perform a throttle operation that makes an output of the engine compatible with drivability.

To achieve the foregoing object, according to a first feature of the present invention, there is provided a control apparatus for an internal combustion engine, comprising: a throttle operator; an opening degree detector that detects an operation opening degree of the throttle operator; and an electronic control throttle device that opens and closes a throttle valve disposed in an intake passage of the internal combustion engine, depending on the operation opening degree detected by the opening degree detector, wherein a throttle valve opening degree of the throttle valve is set to include a zero output throttle opening degree angle at which an output of the engine becomes zero between a low rotational speed region and a high rotational speed region of the engine, and the operation opening degree of the throttle operator corresponding to the zero output throttle opening degree angle is set to an opening-side angle ratio that falls within a range between 8% and 12%, both inclusive, with respect to a fully-open opening degree of the throttle operator.

With the first feature, in controlling the throttle valve opening degree by the electronic control throttle device, the opening degree of the throttle operator corresponding to the zero output throttle opening degree angle is set to the opening-side angle ratio that falls within the range between 8% and 12%, both inclusive, with respect to the fully-open opening degree. Thus, in a vehicle in which quick throttle operation is performed, vehicle deceleration control can be performed even more accurately when the throttle valve is operated in a valve closing direction and acceleration response can be enhanced when the throttle valve is operated in a valve opening direction. When an opening degree ratio falls below 8%, a smaller angle up to full closure results, so that a minute operation amount is required and thus a high level of skill is required. In contrast, when the opening degree ratio exceeds 12%, an increased operation amount results before an acceleration output of the internal combustion engine is reached. Thus, an output increase is slow and acceleration response is degraded.

According to a second feature of the present invention, in addition to the first feature, the operation opening degree of the throttle operator corresponding to the zero output throttle opening degree angle is set to an opening-side angle ratio of 10% with respect to the fully-open opening degree of the throttle operator.

With the second feature, the opening-side angle ratio of 10% is set with respect to the fully-open opening degree. Thus, in a vehicle in which quick throttle operation is performed, vehicle deceleration control can be performed even more accurately when the throttle valve is operated in a valve closing direction and acceleration response can be enhanced when the throttle valve is operated in a valve opening direction. Thus, operability in the valve closing direction can be made compatible with operability in the valve opening direction in an optimally balanced fashion.

According to a third feature of the present invention, in addition to the first or second feature, in the set opening-side angle ratio of the throttle operator, the operation opening degree is set to approximate a zero output value, at which the output of the engine becomes zero, so as to be along the zero output value at a lower rotational speed region of the engine.

With the third feature, in the low rotational speed region of the internal combustion engine, a constant output is maintained with respect to the opening degree ratio in a region in which a change in the output is small with low resistance in the internal combustion engine. Thus, throttle operation giving no sense of discomfort can be performed without any change in a throttle operation characteristic.

According to a fourth feature of the present invention, in addition to the first or second feature, at a throttle opening degree angle resulting in an opening-side angle of a given ratio, the throttle valve opening degree of the throttle valve increases in accordance with an increase of a rotational speed of the engine.

With the fourth feature, the throttle valve opening degree is increased according to the engine resistance. The zero output can thereby be substantially maintained regardless of the rotational speed, so that the throttle operation is made easy throughout a substantially entire rotational speed region of the internal combustion engine.

According to a fifth feature of the present invention, in addition to the fourth feature, the throttle valve opening degree is set so that the output of the engine is increased in proportion to the operation opening degree of the throttle operator and at a rate of increase determined according to the rotational speed of the engine.

With the fifth feature, the opening degree value of the throttle valve opening degree is set so that the engine power output is increased in proportion to the operation opening degree and at the rate of increase determined according to the rotational speed of the internal combustion engine. Thus, a throttle operation characteristic can be obtained by which acceleration and deceleration can be readily performed uniformly over a wide range of opening degrees of throttle operation.

According to a sixth feature of the present invention, in addition to the fifth feature, an opening degree value of the throttle valve opening degree corresponding to the operation opening degree of the throttle operator is set to a same value when the operation opening degree is a predetermined opening degree or more in the low rotational speed region of the engine.

With the sixth feature, the opening degree value of the throttle valve opening degree is set to the same value when the throttle operation opening degree is a predetermined opening degree or more in the low rotational speed region of the internal combustion engine. Thus, the throttle valve opening degree can be kept low even when the throttle is operated greatly in the low rotational speed region of the engine, so that the output of the engine can be suppressed and greater maneuverability can be achieved.

According to a seventh feature of the present invention, in addition to the first or second feature, the control apparatus is applied to a vehicle including the throttle operator that is manually operated.

With the seventh feature, a more accurate throttle operation is performed in the vehicle including the manual throttle operator. Thus, even under a condition in which a high level of skill is required, vehicle deceleration control can be relatively easily performed more accurately and acceleration response can be enhanced when the throttle operator is operated in the valve opening direction.

The above and other objects, characteristics and advantages of the present invention will be clear from detailed descriptions of the preferred embodiment which will be provided below while referring to the attached drawings.

DESCRIPTION OF THE PREFERRED EMBODIMENT

An embodiment of the present invention will be described below with reference to the accompanying drawings. It is here noted that expressions indicating directions including up and down, front and rear, and right and left, are defined on the basis of the line of sight of an occupant riding on a two-wheeled motor vehicle.

Figure 1:
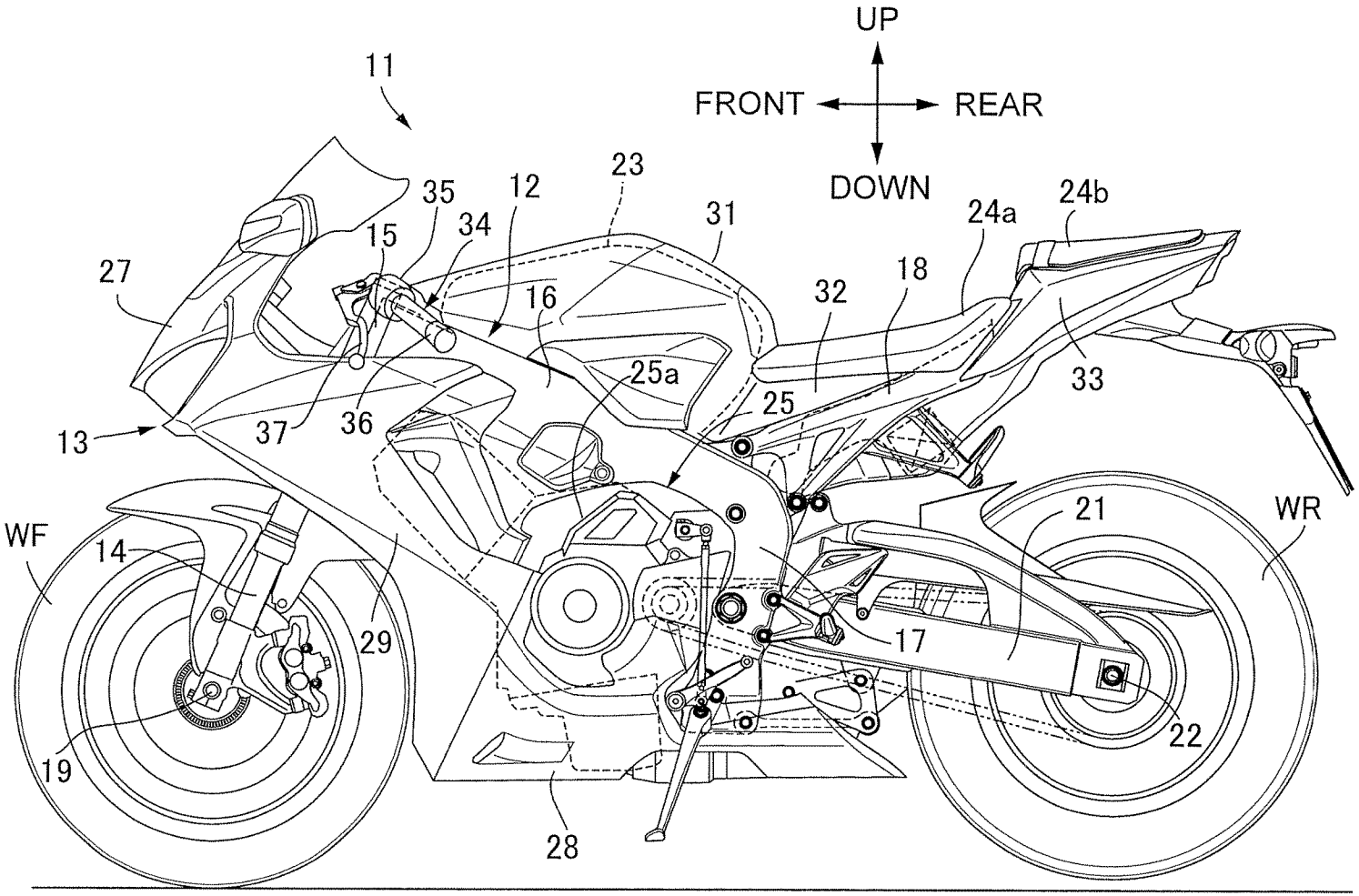
FIG. 1 is a side view schematically depicting a whole configuration of a two-wheeled motor vehicle according to an embodiment of the present invention.
Figure 2:
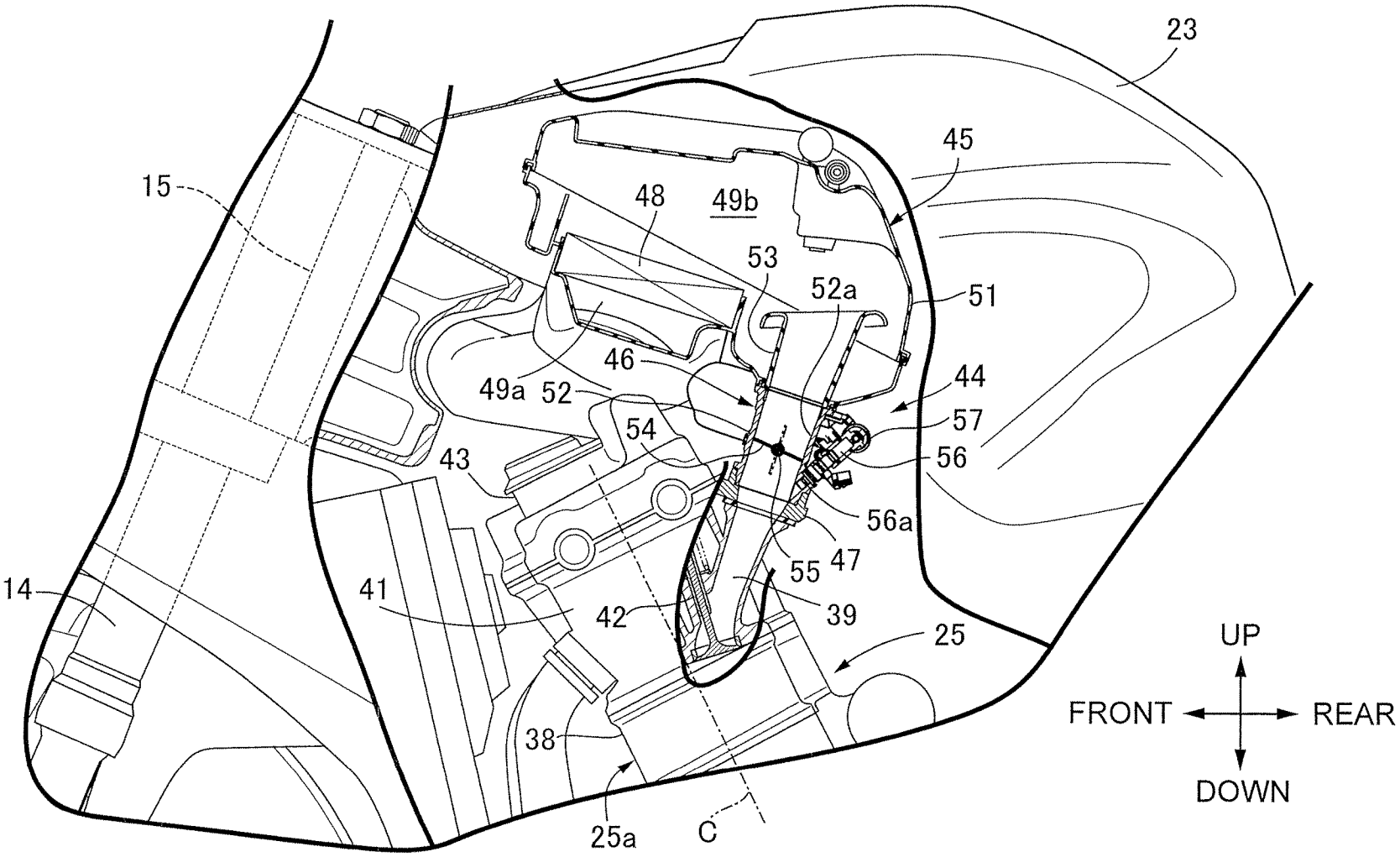
FIG. 2 is an enlarged longitudinal sectional side view of a main part of the two-wheeled motor vehicle according to the embodiment of the present invention.

FIG. 1 schematically depicts a whole configuration of a two-wheeled motor vehicle 11 as a vehicle (e.g., a saddle-ride type vehicle) according to an embodiment of the present invention. The two-wheeled motor vehicle 11 includes a vehicle body frame 12 and a cowl cover 13 mounted on the vehicle body frame 12. The vehicle body frame 12 includes a head pipe 15, a pair of left and right main frames 16, a pair of left and right pivot frames 17, and a pair of left and right seat rails 18. The head pipe 15 steerably supports a front fork 14. The main frames 16 extend downwardly toward the rear from the head pipe 15. The pivot frames 17 extend downwardly from rear ends of the main frames 16. The seat rails 18 extend upwardly toward the rear from the rear ends of the main frames 16. A front wheel WF is supported rotatably about an axle 19 on the front fork 14. A swing arm 21 has a front end connected swingably in the up-down direction with the pivot frames 17. A rear wheel WR is supported rotatably about an axle 22 at a rear end of the swing arm 21. A fuel tank 23 is mounted from above on the main frames 16. The seat rails 18 support a riding front seat 24*a* and a riding rear seat 24*b*, in sequence, in an area behind the fuel tank 23.

An engine main unit 25*a* of an internal combustion engine 25 is supported on the vehicle body frame 12 in an area below the fuel tank 23. The internal combustion engine 25 is connected with the main frames 16 and the pivot frames 17. The internal combustion engine 25 produces power for generating a rotating power for the rear wheel WR. The fuel tank 23 supplies the internal combustion engine 25 with fuel.

The cowl cover 13 includes a front cowl 27, a lower cowl 28, and a center cowl 29. The front cowl 27 is supported by the vehicle body frame 12 in an area above the front wheel WF and covers the head pipe 15 from the front. The lower cowl 28 is supported by the vehicle body frame 12 in an area between the front wheel WF and the rear wheel WR and covers the engine main unit 25*a* from below. The center cowl 29 is continuous from the front cowl 27 and the lower cowl 28 to thereby connect mutually the front cowl 27 and the lower cowl 28 and partially covers a side of the engine main unit 25*a*. The fuel tank 23 is covered with a tank cover 31. A pair of left and right side covers 32 are connected to the tank cover 31. The side covers 32 cover a rear lower portion of the fuel tank 23 from both right and left sides in an area between the fuel tank 23 and the riding front seat 24*a*. A rear cowl 33 covers the seat rail 18 in an area below the riding rear seat 24*b*.

A steering handlebar 34 is connected with the front fork 14. The steering handlebar 34 includes a handlebar 35 that extends laterally to the left and right from the head pipe 15 in a direction in parallel with the axle 19. A left handle grip 36 and a clutch lever 37 are disposed on the left end of the handlebar 35. A grip unit including a right handle grip and a brake lever (not depicted in FIG. 1) are disposed, as will be described later, on the right end of the handlebar 35.

The engine main unit 25*a* includes a cylinder block 38, a cylinder head 41, and a head cover 43. The cylinder block 38 includes four cylinders. The cylinder head 41 is connected with the cylinder block 38 and partitions, for each cylinder, an intake port 39 that communicates with a combustion chamber. A valve mechanism 42 that opens and closes the intake port 39 with respect to the combustion chamber is disposed between the cylinder head 41 and the head cover 43. It is noted that a cylinder axis C is inclined forward and the intake port 39 is formed in the cylinder head 41 so as to extend obliquely upwardly toward the rear.

An intake system 44 is connected with the cylinder head 41. The intake system 44 includes an air cleaner 45, an electronic control throttle device 46, and an insulator 47. The air cleaner 45 is covered with the fuel tank 23 and disposed above the head cover 43. The electronic control throttle device 46 has an upstream end connected with the air cleaner 45. The insulator 47 connects a downstream end of the electronic control throttle device 46 with the head cover 43. The air cleaner 45 includes a cleaner case 51. The cleaner case 51 houses a cleaner element 48 and partitions a non-purification chamber 49*a* and a purification chamber 49*b* that are separated from each other by the cleaner element 48.

The electronic control throttle device 46 includes a throttle body 52. The throttle body 52 partitions an intake passage 52*a* for each cylinder. The intake passage 52*a* has an upstream end connected with the cleaner case 51 through an air funnel 53 that protrudes into the purification chamber 49*b*. The intake passage 52*a* has a downstream end connected with the intake port 39 in the cylinder head 41.

The electronic control throttle device 46 includes a throttle valve 54 disposed in each intake passage 52*a*. The throttle valve 54 is fixedly attached to a valve shaft 55 that traverses the intake passage 52*a* to be rotatably supported in the throttle body 52. The throttle valve 54 rotates about an axis of the valve shaft 55 to thereby open and close the intake passage 52*a*. The engine output of the internal combustion engine 25 is adjusted in accordance with the opening degree of the throttle valve 54.

The throttle body 52 is provided with a fuel injection valve 56 disposed downstream of the throttle valve 54 in each intake passage 52*a*. An injection nozzle 56*a* of the fuel injection valve 56 faces the intake passage 52*a* at a position downstream of the throttle valve 54. Fuel is sprayed from the injection nozzle 56*a* into an airflow through the intake passage 52*a*. A common fuel rail 57 is connected with the fuel injection valve 56. Fuel in the fuel tank 23 is supplied to each fuel injection valve 56 from the fuel rail 57 through the operation of a fuel pump (not depicted).

Figure 3:
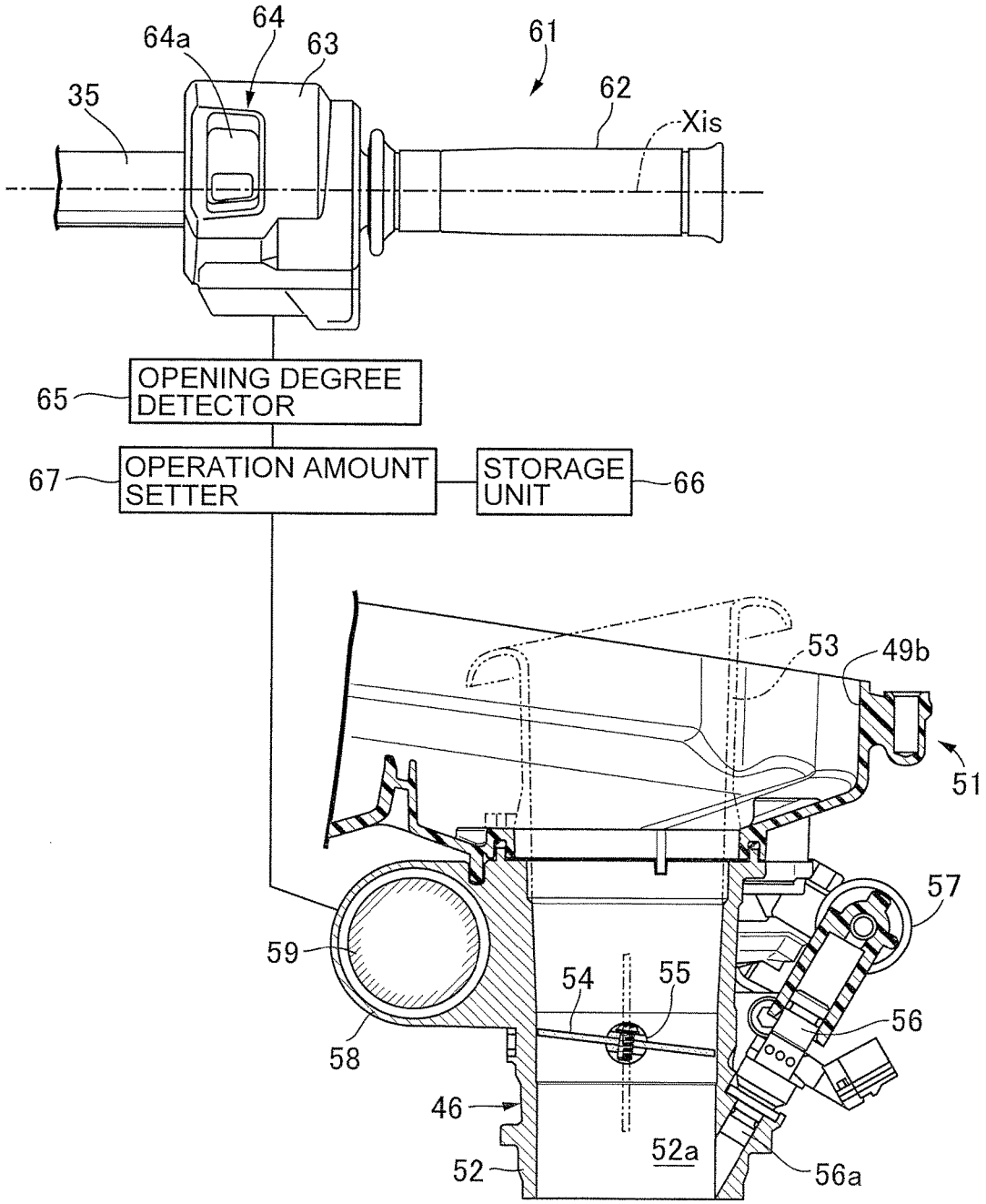
FIG. 3 is a block diagram schematically depicting a control apparatus for an internal combustion engine according to the embodiment of the present invention.

Reference is made to FIG. 3. The electronic control throttle device 46 includes an actuator 58 that is connected with the valve shaft 55 of the throttle valve 54. The actuator 58 includes an electric motor 59 that produces power for rotating the valve shaft 55. The actuator 58 achieves an open/close operation of the throttle valve 54 by driving the throttle valve 54 about the axis of the valve shaft 55 on the basis of a control signal supplied thereto. It is noted that the control signal identifies a control amount (rotation amount or rotation angle) of the electric motor 59 achieving a specified operation amount, that is, a rotation amount (angle) of the throttle valve 54.

A grip unit 61 includes a switch case 63 that is fixed to the handlebar 35 and connected with a right handle grip (throttle operator) 62. The switch case 63 incorporates therein an engine stop switch 64. The engine stop switch 64 is fixed from the inside to the switch case 63. The engine stop switch 64 outputs a switch signal in accordance with a pressing operation on an operating piece 64*a*. The internal combustion engine 25 is started in accordance with an output of the switch signal. The right handle grip 62 is supported by the handlebar 35 rotatably through a predetermined angular range about an axis X is of the handlebar 35. A grip operation of the right handle grip 62 is achieved by a manual operation of a rider.

The electronic control throttle device 46 includes an opening degree detector 65, a storage unit 66, and an operation amount setter 67. The opening degree detector 65 is connected with the right handle grip 62 and detects an operation opening degree of the right handle grip 62. The storage unit 66 holds data that identifies, for each operation opening degree of the right handle grip 62, a control amount of the electric motor 59 achieving predetermined engine output. The operation amount setter 67 is connected with the actuator 58 and the storage unit 66 and supplies the actuator 58 with a control signal that identifies a control amount set as data according to the operation opening degree of the right handle grip 62. The control amount of the electric motor 59 determines the operation amount of the throttle valve 54. The data retained in the storage unit 66 includes table data that identifies a numeric value of the control amount of the electric motor 59 for each discretely identified numeric value of the operation opening degree. For values between adjacent numeric values of the operation opening degree, the operation amount setter 67 may determine the control amount through interpolation. The operation amount setter 67 and the storage unit 66 may each be configured, for example, as an electronic control unit (ECU).

Figure 4:
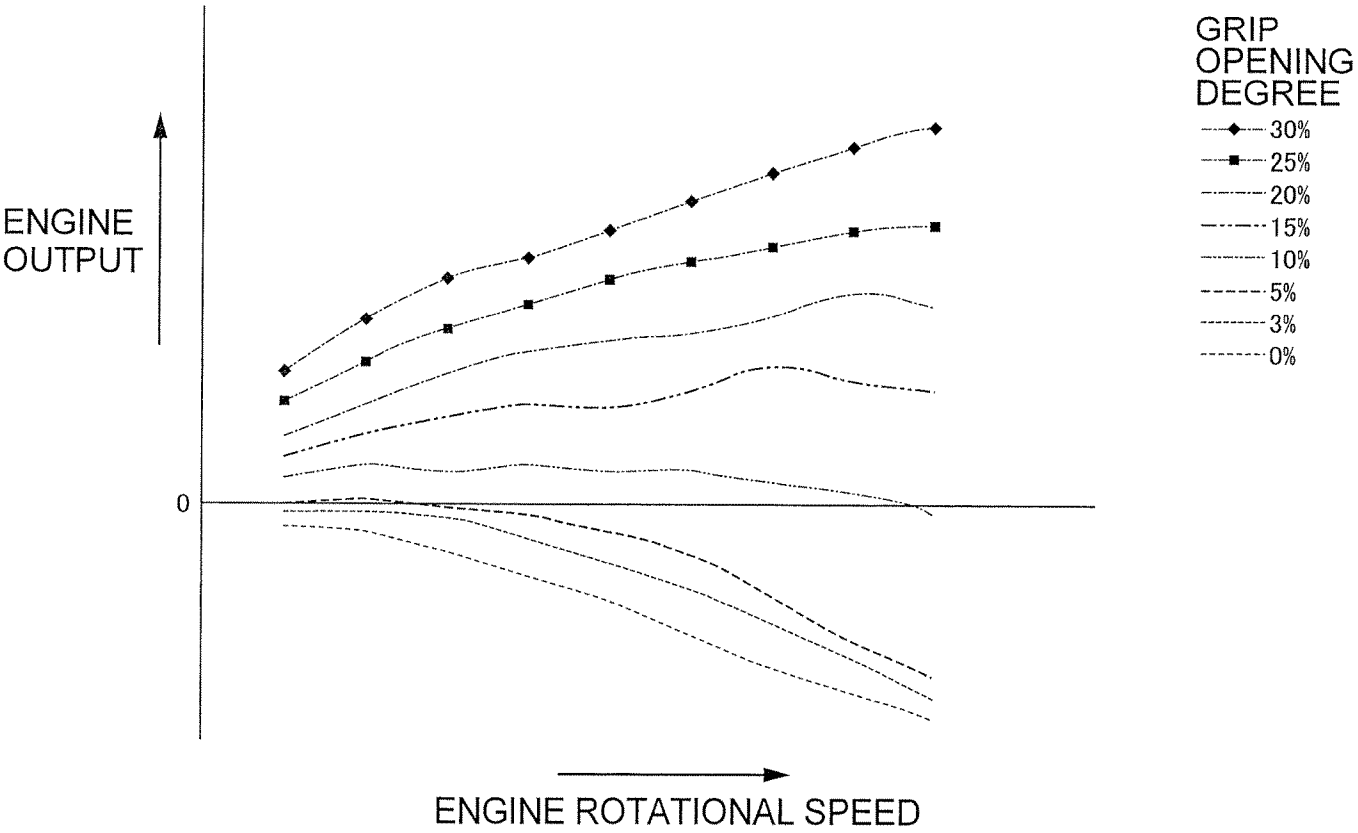
FIG. 4 is a graph depicting a relation between an engine rotational speed and an engine output for each of different grip opening degrees (operation opening degrees).
Figure 5:
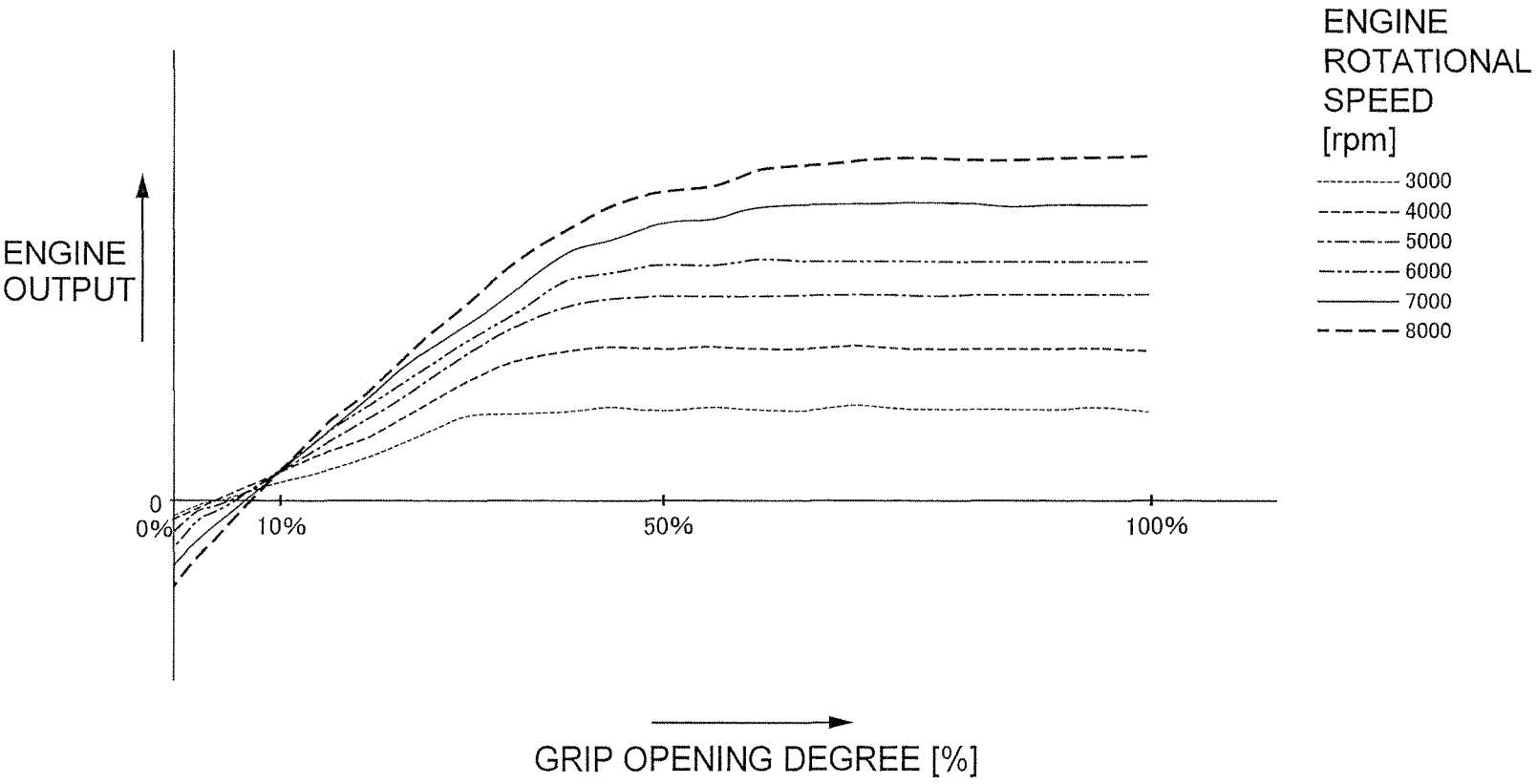
FIG. 5 is a graph depicting a relation between a grip opening degree (operation opening degree) and an engine output for each of different engine rotational speeds.
Figure 6:
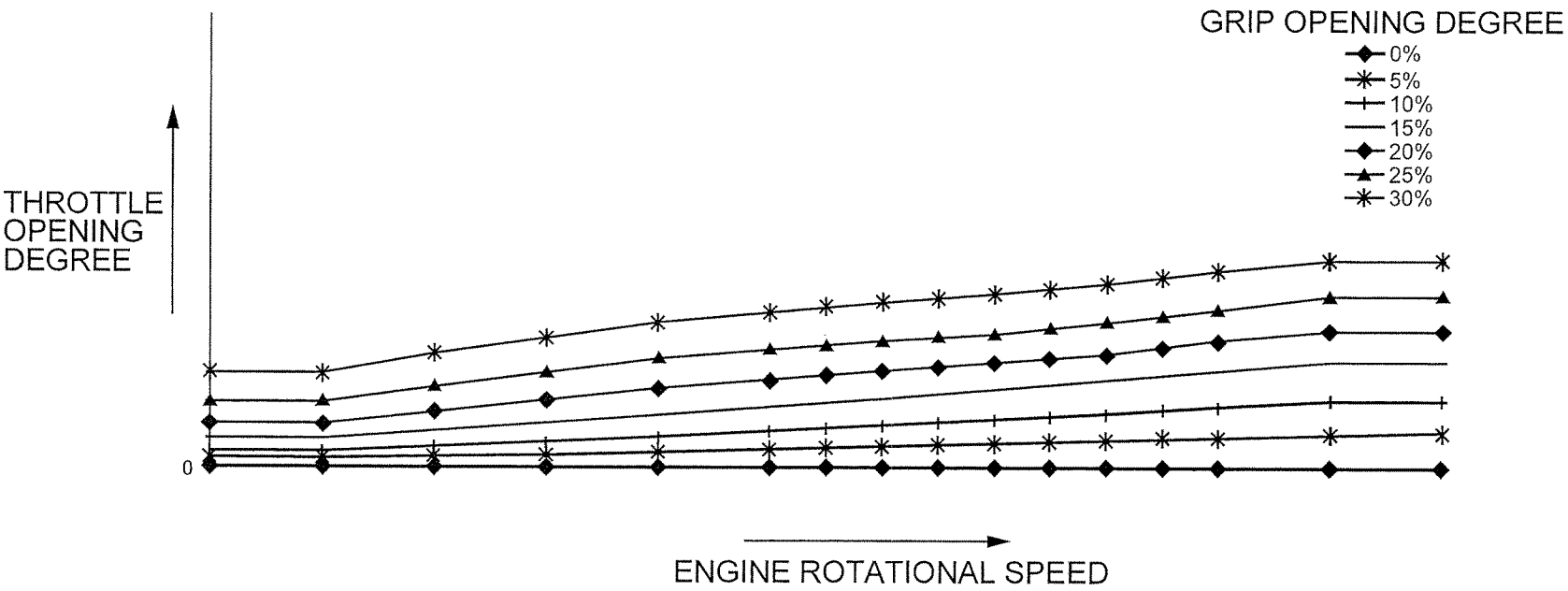
FIG. 6 is a graph depicting a relation between an engine rotational speed and a throttle valve opening degree for each of different grip opening degrees (operation opening degrees) when an exemplary gear shift stage is established.

As depicted in FIG. 4, in the present embodiment, a throttle valve opening degree of the throttle valve 54 is set to include a zero output throttle opening degree angle at which the output of the internal combustion engine 25 is zero between a low rotational speed region and a high rotational speed region of the engine 25. Here, the condition in which the output of the internal combustion engine 25 is "zero" refers to an output condition in which neither an accelerating force nor a decelerating force (engine braking) is generated while the two-wheeled motor vehicle 11 is traveling. The operation opening degree (grip opening degree) corresponding to the zero output throttle opening degree angle of the throttle valve 54 is set to an opening-side angle ratio that falls within a range between 8% and 12%, both inclusive, with respect to a fully-open opening degree of the right handle grip 62. More specifically, the operation opening degree corresponding to the zero output throttle opening degree angle is set to an opening-side angle ratio of 10% with respect to the fully-open opening degree of the right handle grip 62. At this time, as evident from the characteristic curve of a grip opening degree of 10% depicted in FIG. 4, in the opening-side angle ratio of 10% of the right handle grip 62, the operation opening degree is set to approximate a zero output value so as to be along such a value on an output increase side, wherein in the zero output value, the output of the internal combustion engine 25 becomes zero. As can be noted in FIG. 6, at a throttle opening degree angle resulting in an opening-side angle of a given ratio, the throttle valve opening degree of the throttle valve 54 increases in accordance with an increase of the rotational speed of the internal combustion engine 25. Additionally, as depicted in FIG. 5, the throttle valve opening degree is set so that the engine output is increased in proportion to the operation opening degree of the right handle grip 62 and at a rate of increase determined according to the rotational speed of the internal combustion engine 25. As evident from FIG. 5, the opening degree value of the throttle valve opening degree corresponding to the operation opening degree of the right handle grip 62 is set to the same value when the operation opening degree is a predetermined opening degree or more in the low rotational speed region of the engine 25. It is noted that, though FIG. 6 depicts an example at a certain gear shift stage, a different relation is established in accordance with a vehicle traveling characteristic at other gear shift stages.

Operation of the present embodiment will be described below. The occupant of the two-wheeled motor vehicle 11 uses his or her right hand to grip the right handle grip 62 to operate the control apparatus for the internal combustion engine 25. The right handle grip 62 can be rotated about the axis X is of the handlebar 35 through an operation opening degree range, for example, of 0 to 60 degrees. The opening degree detector 65 detects the operation opening degree of the right handle grip 62. The opening degree detector 65 outputs an electric signal corresponding to the detected operation opening degree. The operation amount setter 67, using the electric signal supplied from the opening degree detector 65 and the table data retained in the storage unit 66, identifies a control amount of the electric motor 59. The operation amount setter 67 outputs to the actuator 58 a control signal that identifies the control amount corresponding to the detected operation opening degree. The actuator 58 operates the electric motor 59 using the specified control amount to thereby drive the throttle valve 54. Thereby, the output of the internal combustion engine 25 is controlled in the two-wheeled motor vehicle 11.

In controlling the throttle valve opening degree by the electronic control throttle device 46, the opening degree of the right handle grip 62 corresponding to the zero output throttle opening degree angle is set to the opening-side angle ratio that falls within the range between 8% and 12%, both inclusive, with respect to the fully-open opening degree. This arrangement enables, in a vehicle in which quick throttle operation is performed, vehicle deceleration control to be performed even more accurately when the throttle valve is operated in a valve closing direction and acceleration response to be enhanced when the throttle valve is operated in a valve opening direction. When an opening degree ratio falls below 8%, a smaller angle up to full closure results, so that a minute operation amount is required and thus a high level of skill is required. In contrast, when the opening degree ratio exceeds 12%, an increased operation amount results before an acceleration output of the internal combustion engine 25 is reached. Thus, an output increase is slow and acceleration response is degraded.

The operation opening degree of the right handle grip 62, particularly the operation opening degree corresponding to the zero output throttle opening degree angle is set to an opening-side angle ratio of 10% with respect to the fully-open opening degree of the right handle grip 62. Thus, in a vehicle in which quick throttle operation is performed, vehicle deceleration control can be performed even more accurately when the throttle valve 54 is operated in a valve closing direction and acceleration response can be enhanced when the throttle valve 54 is operated in a valve opening direction. Thus, operability in the valve closing direction can be made compatible with operability in the valve opening direction in an optimally balanced fashion.

In the set opening-side angle ratio of the right handle grip 62, the operation opening degree of the right handle grip 62 is set to approximate the zero output value, at which the output of the internal combustion engine 25 becomes zero, so as to be along the zero output value at a lower rotational speed region of the internal combustion engine 25. In the low rotational speed region of the internal combustion engine 25, a constant output is maintained with respect to the opening degree ratio in a region in which a change in the output is small with low resistance in the internal combustion engine 25. This approach enables throttle operation giving no sense of discomfort without any change in a throttle operation characteristic.

In the set opening-side angle ratio of the right handle grip 62, the operation opening degree of the right handle grip 62 is set to approximate the zero output value, at which the output of the internal combustion engine 25 becomes zero, so as to be along the zero output value on the output increase side at a lower rotational speed region of the internal combustion engine 25. The being along the zero output value on the output increase side with allowance for resistance in the internal combustion engine 25 enables the operation opening degree to approximate the zero output value.

At a throttle opening degree angle resulting in the opening-side angle of a given ratio, the throttle valve opening degree of the throttle valve 54 increases in accordance with an increase of the rotational speed of the internal combustion engine 25. Increasing the throttle valve opening degree according to the engine resistance substantially allows the zero output to be maintained regardless of the rotational speed, so that the throttle operation is made easy throughout a substantially entire rotational speed region of the internal combustion engine 25.

The throttle valve opening degree is set so that the engine output is increased in proportion to the operation opening degree of the right handle grip 62 and at a rate of increase determined according to the rotational speed of the internal combustion engine 25. This can achieves a throttle operation characteristic by which acceleration and deceleration can be readily performed uniformly over a wide range of opening degrees of throttle operation.

The opening degree value of the throttle valve opening degree corresponding to the operation opening degree of the right handle grip 62 is set to the same value when the throttle operation opening degree is a predetermined opening degree or more in the low rotational speed region of the internal combustion engine 25. The arrangement in which the opening degree value of the throttle valve opening degree is set to the same value when the throttle operation opening degree is a predetermined opening degree or more in the low rotational speed region of the internal combustion engine 25 causes the throttle valve opening degree to be kept low even when the throttle is operated greatly in the engine low rotational speed region, to thereby suppress the engine output and achieve greater maneuverability.

A more accurate throttle operation is performed in the two-wheeled motor vehicle 11 including the manual throttle operator. Thus, even under a condition in which a high level of skill is required, vehicle deceleration control can be relatively easily performed more accurately and acceleration response can be enhanced when the throttle operator is operated in the valve opening direction.

As described above, the control apparatus according to the present embodiment includes the right handle grip 62 (throttle operator) that operates depending on the operation amount, the opening degree detector 65 that is connected with the right handle grip 62 and that detects the operation opening degree of the right handle grip 62, the throttle valve 54 that is disposed in the intake passage 52*a* of the internal combustion engine 25 and is driven by the actuator 58, the storage unit 66 that holds data that sets, per unit operation opening degree, an operating opening degree of the throttle valve 54 smaller than the operation opening degree exceeding a specific throttle operation opening degree at an operation opening degree equal to or smaller than the specific throttle operation opening degree, and the operation amount setter 67 that is connected with the actuator 58 and the storage unit 66 and that supplies the actuator 58 with a control signal that identifies a control amount set using data in the storage unit 66 according to the operation opening degree. The actuator 58 drives the throttle valve 54 according to the control signal supplied thereto. Because a small operating opening degree is set per unit operation opening degree at an operation opening degree equal to or smaller than the specific throttle operation opening degree, accurate deceleration control can be achieved over a region of minus output to zero output. Meanwhile, acceleration response can be achieved at the operation opening degree exceeding the specific throttle operation opening degree.

As evident from FIG. 5, the data retained in the storage unit 66 sets the control amount that results in an increase of the engine output in accordance with an increase of the operation opening degree over the entire operation opening degree range. The operation in the valve opening direction invariably leads to an increase of the engine output, so that drivability of the vehicle is improved. In addition, the data sets the control amount that establishes an equal engine output in a specific rotational speed region for a specific throttle operation opening degree. Drivability of the vehicle is improved because the equal engine output is established at a single throttle operation opening degree over the specific rotational speed region. As described previously, reliably accurate deceleration control can be achieved over the region of minus output to zero output and acceleration response can be enhanced with an operation in the valve opening direction.

The control apparatus according to the present embodiment includes the right handle grip 62 (throttle operator) that operates depending on the operation amount, the opening degree detector 65 that is connected with the right handle grip 62 and that detects the operation opening degree of the right handle grip 62, the throttle valve 54 that is disposed in the intake passage 52*a* of the internal combustion engine 25 and is driven by the actuator 58, the storage unit 66 that holds data that sets an operating opening degree of the throttle valve 54 on the basis of a relation between the operation opening degree and the engine output that varies linearly with respect to the operation opening degree at least in the low rotational speed region of the internal combustion engine 25, and the operation amount setter 67 that is connected with the actuator 58 and the storage unit 66 and that supplies the actuator 58 with a control signal that identifies a control amount set as data depending on the operation opening degree. The actuator 58 drives the throttle valve 54 according to the control signal supplied thereto. As a result, the engine output varies linearly with respect to the operation opening degree of the right handle grip 62 in the low rotational speed region of the internal combustion engine 25. Drivability of the vehicle is improved.

The control apparatus according to the present embodiment includes the right handle grip 62 (throttle operator) that operates depending on the operation amount, the opening degree detector 65 that is connected with the right handle grip 62 and that detects the operation opening degree of the right handle grip 62, the throttle valve 54 that is disposed in the intake passage 52*a* of the internal combustion engine 25 and is driven by the actuator 58, the storage unit 66 that holds data that sets an operating amount of the throttle valve 54 for maintaining a relative relation between the operation opening degree and engine output at a plurality of gear shift stages, and the operation amount setter 67 that is connected with the actuator 58 and the storage unit 66 and that supplies the actuator 58 with a control signal that identifies a control amount set as data depending on the operation opening degree. Drivability of the vehicle is improved because an engine output equivalent to the operation opening degree of the right handle grip 62 is established even with different gear shift stages.

What is claimed is:

1. A control apparatus for an internal combustion engine, comprising:

a throttle operator movable between a fully-closed side end position and a fully-open side end position to determine an operation opening degree;

an opening degree detector that detects the operation opening degree of the throttle operator; and an electronic control throttle device that opens and closes a throttle valve disposed in an intake passage of the internal combustion engine, depending on the operation opening degree of the throttle operator detected by the opening degree detector, wherein an opening degree of the throttle valve is includes a zero output throttle opening degree angle at which an output of the engine becomes zero over an operation range of the internal combustion engine between a low rotational speed region and a high rotational speed region of the internal combustion engine, wherein the operation opening degree of the throttle operator corresponding to the zero output throttle opening degree angle is set to an opening-side angle ratio of 10% with respect to the fully-open side end position of the throttle operator, and wherein in the set opening-side angle ratio of the throttle operator, the operation opening degree is set to approximate a zero output value, at which the output of the engine becomes zero, so as to be along the zero output value at the lower rotational speed region of the engine.

2. A control apparatus for an internal combustion engine, comprising:

a throttle operator movable between a fully-closed side end position and a fully-open side end position to determine an operation opening degree;

an opening degree detector that detects the operation opening degree of the throttle operator; and an electronic control throttle device that opens and closes a throttle valve disposed in an intake passage of the internal combustion engine, depending on the operation opening degree of the throttle operator detected by the opening degree detector, wherein an opening degree of the throttle valve includes a zero output throttle opening degree angle at which an output of the engine becomes zero over an operation range of the internal combustion engine between a low rotational speed region and a high rotational speed region of the internal combustion engine wherein the operation opening degree of the throttle operator corresponding to the zero output throttle opening degree angle is set to an opening-side angle ratio that falls within a range between 8% and 12%, both inclusive, with respect to the fully-open side end position of the throttle operator, and wherein in the set opening-side angle ratio of the throttle operator, the operation opening degree is set to approximate a zero output value, at which the output of the engine becomes zero, so as to be along the zero output value at a lower rotational speed region of the engine.

3. The control apparatus for the internal combustion engine according to claim 1, wherein, at a throttle opening degree angle resulting in an opening-side angle of a given ratio, the opening degree of the throttle valve increases in accordance with an increase of a rotational speed of the engine.

4. The control apparatus for the internal combustion engine according to claim 3, wherein the opening degree of the throttle valve is set so that the output of the engine is increased in proportion to the operation opening degree of the throttle operator and at a rate of increase determined according to the rotational speed of the engine.

5. The control apparatus for the internal combustion engine according to claim 4, wherein a value of the opening degree of the throttle valve corresponding to the operation opening degree of the throttle operator is set to a same value when the operation opening degree is a predetermined opening degree or more in the low rotational speed region of the engine.

6. The control apparatus for the internal combustion engine according to claim 1, wherein the control apparatus is applied to a vehicle including the throttle operator that is manually operated.

* * * * *